US005873320A

United States Patent [19]

Gordon

[11] Patent Number: 5,873,320

[45] Date of Patent: Feb. 23, 1999

[54] DAMPENING SYSTEM FOR USE IN TOWING A VESSEL

[76] Inventor: Michael D. Gordon, 2643 7th St., Apartment A, Culver City, Calif. 90230

[21] Appl. No.: 816,446

[22] Filed: Mar. 12, 1997

[51] Int. Cl.[6] ..... B63B 21/04

[52] U.S. Cl. ..... 114/253

[58] Field of Search ..... 114/242, 249, 114/247, 251, 252, 253, 213, 215, 216; 280/485, 486, 487, 483; 267/138, 68, 70, 71, 72

[56] References Cited

U.S. PATENT DOCUMENTS

| | | | |
|---|---|---|---|
| 852,946 | 5/1907 | Promholtz | 114/215 |
| 2,033,035 | 3/1936 | Koons | 114/213 |
| 2,585,768 | 2/1952 | Ham | 280/487 |
| 3,109,075 | 10/1963 | Ratcliff | 114/253 |
| 4,205,619 | 6/1980 | Mock, Jr. et al. | 114/242 |
| 4,817,978 | 4/1989 | James | 267/138 |

*Primary Examiner*—Ed L. Swinehart
*Attorney, Agent, or Firm*—W. Edward Johansen

[57] ABSTRACT

A towboat uses a dampening system with a towline to tow a vessel. The dampening system includes a housing, a beam, a first towline connector, a second towline connector, a spring and a plurality of shock absorbers. The housing is attached to the towboat. The beam is slidably coupled within the housing. The spring resiliently couples the beam to the housing. Each shock absorber is connected to the housing and mechanically coupled to the beam. The towline connector is mechanically coupled to the beam. The towline is connected to the towline connector.

3 Claims, 3 Drawing Sheets

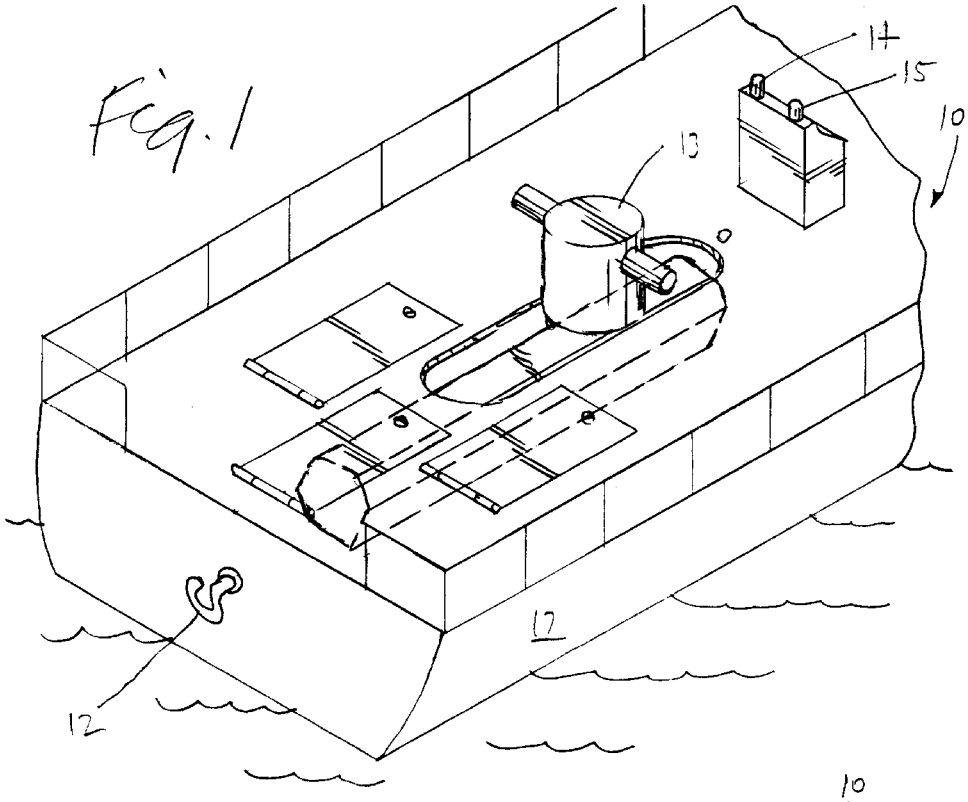
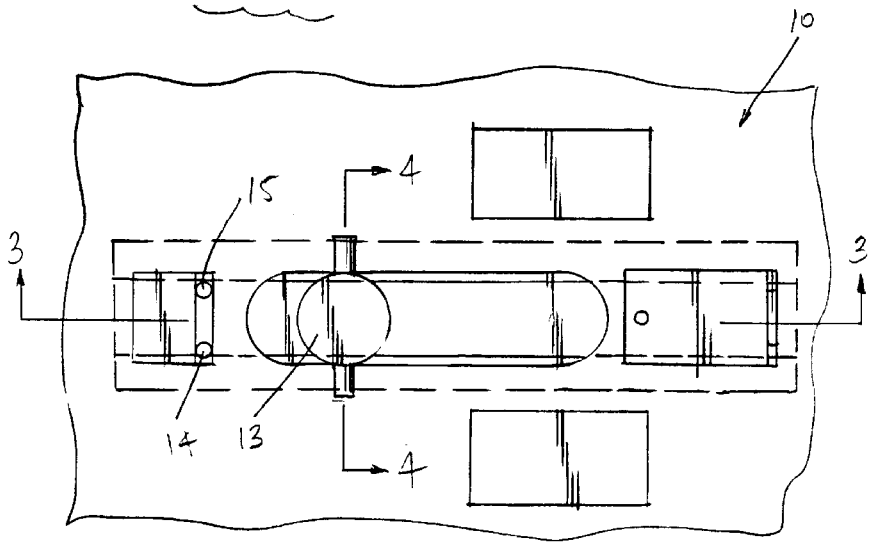
Fig. 2

DAMPENING SYSTEM FOR USE IN TOWING A VESSEL

BACKGROUND OF THE INVENTION

The field of the invention relates to dampening systems suitable for use in towing vessels.

In towing logs, log rafts and barges, a towline extends from a towboat. On open smooth or calm water, the tension in the towline remains nearly constant irrespective of the towline length provided the towboat maintains a constant power output; the towboat and tow proceed through the water at a uniform speed. In narrow waterways, however, changes in direction and speed are required. In all waterways, winds create conditions where the towboat and what it is towing will proceed generally in one direction and at the same average speed but their instantaneous relative speeds will vary depending on towline length, wave height and direction of travel, tow mass, towboat mass, wind velocity and direction of travel, and other such factors. Changes in the relative motion of the towboat and tow cause longitudinal and transverse travelling waves in the towline. The most severe changes in relative speed of towboat and tow generate what may be regarded as shock loads. Some of these shock loads occur predictably from time to time when a towboat and tow are maneuvering in a waterway. Other such shock loads occur unexpectedly under simple or straight towing in rough seas under random slamming conditions. Severe shock loads and travelling waves are believed to contribute to the occasional failure of towlines through the mechanisms respectively of overstressing and metal fatigue. One method of towing wherein these mechanisms are inhibited uses very long towlines. Another uses heavy weights attached to the towline lengths of heavy chain forming a portion of the towline near the tow end of the towline. In both of these cases, the towline takes on the approximate shape of a catenary. As the towboat and tow move apart the towline is raised through the water and as they move together the towline falls to a lower position. These means are inadequate in that they cannot be used effectively in narrow waterways where the towline must be short, they lead to frequent snagging of the towline on the bottom of shallow waterways, and their being dragged through water significantly impairs towing efficiency.

Still other means for overcoming shock loading and travelling waves in towlines include a towboat winch which pays out and retracts towline according to towline loads or other self-rendering devices which can be clamped to a towline at a towboat. These means have had limited application due to space limitations on a towboat and to towline wear which is inevitable when a towline is continuously dragged back and forth over the back of a towboat and unwound and rewound on a winch. Other means have been devised where handling of heavy and awkward shock absorbing means and the exposure of sensitive elements to water and weather have limited their application. Other means have been devised wherein the use of hydraulic fluid in a cylinder would not permit rapid response to shock loads. Still other means have been devised wherein a combination of springs, hydraulic cylinders, cables, and pulleys have created large friction losses and large differences between payout and retraction towline forces.

The limitations of known means are overcome by providing a towline shock absorbing and wave damping means which can be inserted between a towline and a tow. Connecting means, adapted to balance several coplanar forces, joins ends of a towline, a pendent means, and a flexible tension member. The towline is attached at its other end to towing means. The pendant means is attached at its other end to a tow. The flexible tension member passes through a guide and is attached at its other end to an extensible member of pneumatic cylinder means. The guide aligns the axis of a portion of the flexible tension member with the axis of the extensible member while permitting the end of the flexible tension member attached to the connecting means to be moved freely by the towline, subject to constraint of the pendant means and flexible tension member. Gas is maintained within the pneumatic cylinder by structure and at a pressure such that the extensible member restrains the flexible tension members. The pressure within the cylinder, is however, at a level which permits the extensible member quickly to react extensibly to changes in towing force, absorb shock loads, and dampen travelling waves in the towline. The gas in the cylinder stores shock and surge energy and returns it to the towing means and tow when a shock load in the towline has subsided. The pendant means and flexible tension member share a geometric relationship and the pressure within the pneumatic cylinder is such that a normal towline force is substantially supported by the pneumatic cylinder but a severe shock load is substantially shared by the pendant means and the pneumatic cylinder.

In towing a vessel, particularly in ocean waters, extremely high tensions are generated in the towing gear or line. These tensions are caused by the wave action on the towed and towing vessels and the resulting relative movement of the vessels. The magnitude of this tension often greatly exceeds the strength of the points on the vessels to which the line is attached. Long lines are generally used to permit the relative movement and attenuate the tension created by the wave motion. The stretching and movement of the line absorbs energy thereby attenuating the forces that would otherwise be exerted on the vessels.

It is common to utilize very long sagging tow lines in order to absorb and dissipate sufficient energy to attenuate the forces caused by wave action to a tolerable level. Typically, lines of 2,500 to 5,000 feet are utilized. These lines, while supplying the required attenuation, have the disadvantage of having considerable drag since they must be towed through the water by the towing vessel. Often, as much as 35 percent of the towing vessel's power is utilized to tow the line connecting the two vessels.

A similar problem exists with mooring a vessel. Wave action on the moored vessel, particularly when the vessel is moored in rough waters, creates high tensions in the mooring cables. It is a common practice to utilize long mooring lines in order to attenuate these forces.

One prior art attempt to solve part of the problem is to employ springs interposed in the tow line. Such a solution has in general, been impractical and unacceptable. The springs employed are large and heavy. For example, to obtain the desired compensation, a spring of 40 feet in length may be required. In addition, it may create a snapback situation which could result in even greater forces. Finally, the desired spring rate and load buildup is extremely difficult to achieve with a practical and economical spring.

U.S. Pat. No. 3,570,441 teaches an apparatus for use at the tow end of a marine towline which absorbs shock loads and damp travelling waves in said towline. A marine towline is attached to an element which is restrained by a pendant attached to a tow and by a flexible tension member attached to an extensible member of a pneumatic cylinder, another member of which cylinder is attached to the tow. The geometric relationship of the pendant and flexible tension member is such that a shock load in the towline is initially borne substantially by the pneumatic cylinder but progressively shared with the pendant as the extensible member of the pneumatic cylinder extends. This apparatus effects shock load and travelling wave damping in marine towlines while at the same time absorbing shock energy and returning it substantially without loss to a towboat and tow.

U.S. Pat. No. 3,576,170 teaches a surge dampener which is particularly adaptable for mooring and towing vessels. The surge dampener is coupled in the line or gear utilized to either moor or tow a vessel. The forces created in the line by the action of the wave motion on the vessels are greatly dampened thereby reducing the force applied to the line and to the points to which they are secured. The surge dampener is pivotally coupled to a secure point on a vessel when used as part of a towing system. The surge dampener includes a hydraulic cylinder having a piston and a piston rod. The piston rod is coupled to the line which is used to moor or tow a vessel. An accumulator cylinder, which is coupled to the hydraulic cylinder, contains a free piston which separates hydraulic fluid from a gas or pneumatic section of the hydraulic cylinder. The accumulator is adapted to receive hydraulic fluid from the hydraulic cylinder when the piston rod moves. As fluid is forced into the accumulator, the gas in the pneumatic section of the accumulator cylinder is compressed. Work is performed on both the hydraulic cylinder and gas which absorbs energy from the movement of the piston rod. This energy absorption and loss attenuates the forces applied to the line or gear, particularly those generated by wave action.

Heretofore, towing of load carrying vessels, such as barges, in heavy seas has been accomplished by pulling the vessel with the towboat by a long pull-towline hanging substantially in a catenary to accommodate instantaneous variations in forward motion of the two vessels. Although push-towing has been quite common in protected waters, even techniques, which U.S. Pat. No. 2,984,202 teaches, become extremely dangerous in the rough water encountered in off-shore or deep sea towing service. The danger in part results from the inability of these arrangements to cast off and rapidly separate towboat and barge, if necessary, or from the dynamic load occurring upon reengagement of towboat and barge after a sea-caused separation, or from possible foundering of a heavily laden tow.

U.S. Pat. No. 3,645,225 teaches a pusher towboat which normally propels a load carrying vessel by pushing contact at the centerline of the stern of the vessel with a towboat-mounted shock absorbing pusher knee. A pair of tensioned rapidly detachable tiller lines interconnecting the vessel and the stern of the towboat lash the vessel and towboat together with a force substantially greater than the astern power of the towboat and stores energy in the pusher knee to rapidly separate towboat and vessel upon detachment of the tiller lines. A connected, but normally nonoperational, pull-towline enables pull-tow control of the vessel upon tiller line detachment. The points of connection of the tiller lines to the vessel, the point of pushing contact between towboat and vessel, and the points of connection of the tiller lines to the stern of the towboat lie in substantially the same horizontal plane. Relative length of the two tiller lines is adjustable under load but at equal tension, so that towboat thrust is available for steering the load carrying vessel by a variation in longitudinal alignment of the towboat with respect to the vessel.

The inventors incorporate the teachings of the above-cited patents into this specification.

SUMMARY OF INVENTION

The present invention is generally directed to a dampening system which is for use by a towboat with a towline to tow a vessel. The dampening system includes a housing and a towline connector. The housing is attached to the towboat. The towline connector is mechanically coupled to the housing and the towline connector.

In a first, separate aspect of the present invention, the dampening system includes a beam, a spring and a plurality of shock absorbers. The beam is slidably coupled within the housing. The spring resiliently couples the beam to the housing. Each shock absorber is connected to the housing and mechanically coupled to the beam.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE DRAWINGS

FIG. 1 is a perspective drawing of a dampening system for use by a towboat with a towline to tow a vessel according to the present invention.

FIG. 2 is a top plan view of the dampening system of FIG. 1.

DESCRIPTION OF THE PREFERRED EMBODIMENTS

Figure 3:
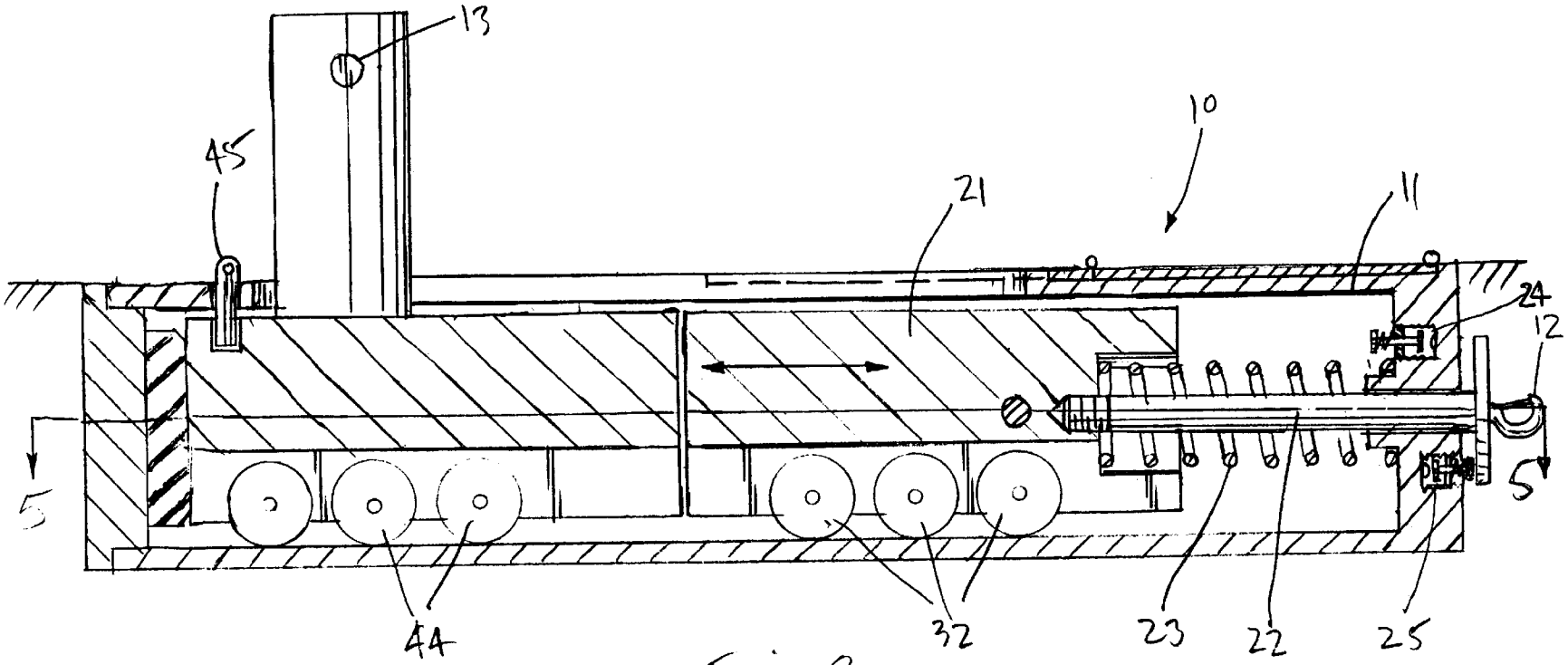
FIG. 3 is a cross-sectional view of the dampening system of FIG. 1 taken along line 3—3 of FIG. 2.

Referring to FIG. 1 in conjunction with FIG. 2 a dampening system 10 includes a housing 11, a first towline connector 12, a second towline connector 13, a caution light 14, a warning light 15 and an electrical source 16. The housing 11 is attached to a towboat 17. A towline is connected to either the first towline connector 12 or the second towline connector 13. The towboat 17 uses the dampening system 10 with the towline to tow vessels, logs, log rafts or barges.

Referring to FIG. 3 the dampening system 10 also includes a first beam 21, a rod 22, a spring 23, a caution switch 24 and a warning switch 25. The spring 23 resiliently couples the beam 21 to the housing 11. The caution switch 24 electrically couples the caution light 14 to the electrical source 16. The warning switch 25 electrically couples the warning light 15 to the electrical source 16.

Figure 4:
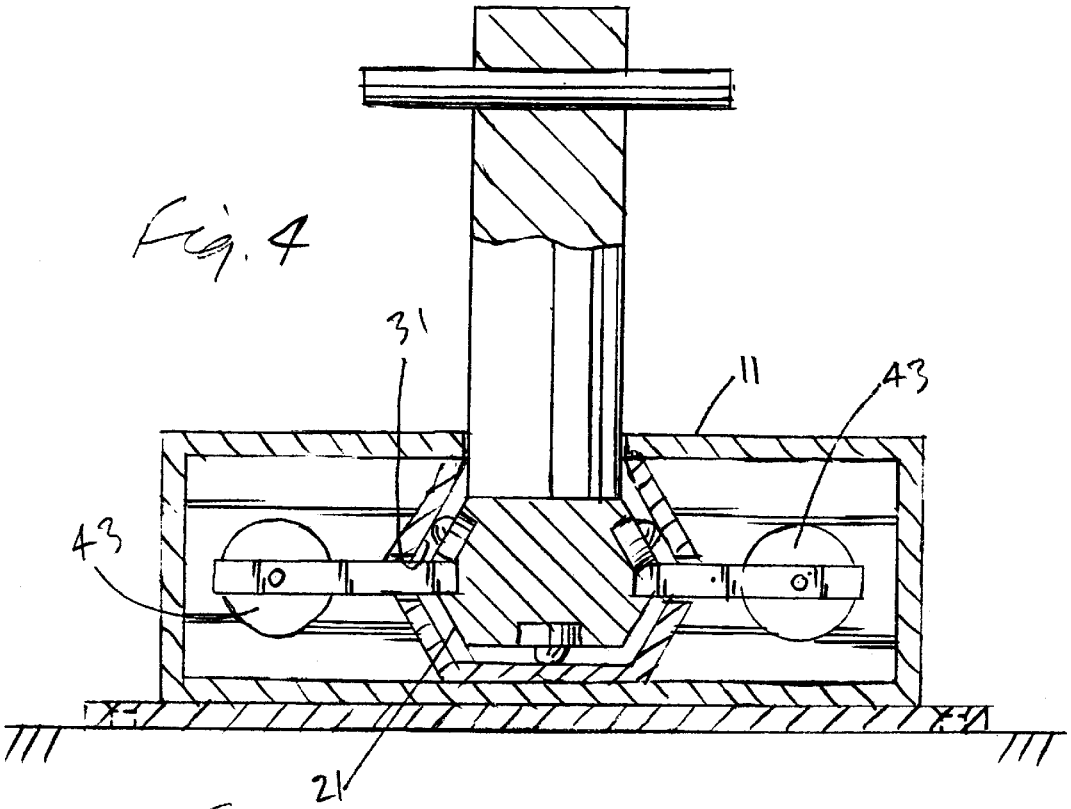
FIG. 4 is a cross-sectional view of the dampening system of FIG. 1 taken along line 4—4 of FIG. 2.

Referring to FIG. 3 in conjunction with FIG. 4 the housing 11 has an elongated, hexagonally shaped cavity 31 with six surfaces. The first beam 21 is an elongated, hexagonally shaped member with six surfaces, each of which is oppositely disposed adjacent to one of the six surfaces of the elongated, hexagonally shaped cavity 31. The first beam 21 has a first plurality of sets of wheels 22 on each of at least three of the six surfaces so that the first beam 21 is slidably coupled within the elongated, hexagonally shaped cavity 31 of the housing 11.

Figure 5:
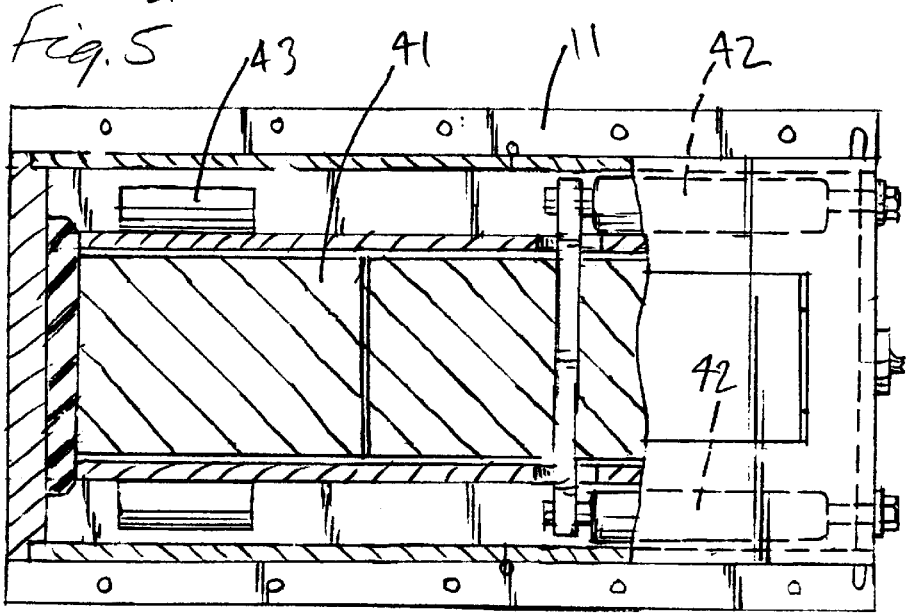
FIG. 5 is a partial cross-sectional view of the dampening system of FIG. 1 taken along line 5—5 of FIG. 3.

Referring to FIG. 4 in conjunction with FIG. 5 the dampening system 10 further includes a second beam 41 a plurality of shock absorbers 42, a plurality of air cylinders

43. The second beam 41 is an elongated, hexagonally shaped member with six surfaces, each of which is oppositely disposed adjacent to one of the six surfaces of the elongated, hexagonally shaped cavity 31. The second beam 41 has a second plurality of sets of wheels 44 on each of at least three of the six surfaces so that the second beam 41 is slidably coupled within the elongated, hexagonally shaped cavity 31 of the housing 11. Each shock absorber 42 is connected to the housing 11 and mechanically coupled to the first beam 21. The second towline connector 13 is mechanically coupled to the second beam 41. A pin 45 securely couples the second beam 41 to the housing 11 when the first towline connector 12 is in use. The pin 45 is removed when the second towline connector 13 is in use.

From the foregoing it can be seen that a dampening system for use by a towboat with a towline to tow vessels, logs, log rafts or barges has been described. It should be noted that the sketches are not drawn to scale and that distance of and between the figures are not to be considered significant.

Accordingly it is intended that the foregoing disclosure and showing made in the drawing shall be considered only as an illustration of the principle of the present invention.

What is claimed is:

1. A towboat with a dampening system having a towline for towing vessels, logs, log rafts or barges, said towboat with a dampening system comprising:

a. a towboat;

b. a housing attached to said towboat, said housing having an elongated, hexagonally shaped cavity with six surfaces;

c. a first beam slidably coupled within said housing, said beam being an elongated, hexagonally shaped member with six surfaces each of which is oppositely disposed adjacent to one of the six surfaces of the elongated, hexagonally shaped cavity;

d. a second beam slidably coupled within said housing, said beam being an elongated, hexagonally shaped member with six surfaces each of which is oppositely disposed adjacent to one of the six surfaces of the elongated, hexagonally shaped cavity and said dampening system e. a towline connector mechanically coupled to said beam, said towline being connected to said towline connector;

f. a spring resiliently couples said first beam to said housing;

g. a plurality of shock absorbers each of which is connected to said housing and mechanically coupled to said first beam;

h. a rod mechanically coupled to said first beam; and i. a spring resiliently coupling said first beam to said housing.

2. A towboat with a dampening system according to claim 1 wherein said towboat with a dampening system includes:

a. an electrical source disposed in said housing;

b. a warning light mechanically coupling said housing to said beam; and c. a warning switch electrically coupling said warning light to said electrical source.

3. A towboat with a dampening system according to claim 2 wherein said towboat with a dampening system also includes:

a. a caution light mechanically coupling said housing to said beam; and b. a caution switch electrically coupling said caution light to said electrical source.

* * * * *